US010569943B2

(12) United States Patent
Li

(10) Patent No.: US 10,569,943 B2
(45) Date of Patent: Feb. 25, 2020

(54) SEALING COVER

(71) Applicant: Ping Li, Guangdong (CN)

(72) Inventor: Ping Li, Guangdong (CN)

( * ) Notice: Subject to any disclaimer, the term of this patent is extended or adjusted under 35 U.S.C. 154(b) by 96 days.

(21) Appl. No.: 15/580,266

(22) PCT Filed: Jun. 8, 2016

(86) PCT No.: PCT/CN2016/085193
§ 371 (c)(1),
(2) Date: Dec. 6, 2017

(87) PCT Pub. No.: WO2016/197930
PCT Pub. Date: Dec. 15, 2016

(65) Prior Publication Data

US 2018/0162611 A1 Jun. 14, 2018

(30) Foreign Application Priority Data

Jun. 20, 2015 (CN) ..... 2015 2 0399333 U

(51) Int. Cl.
*B65D 51/24* (2006.01)
*B65D 39/12* (2006.01)
(Continued)

(52) U.S. Cl.
CPC ..... *B65D 51/243* (2013.01); *B65D 39/12* (2013.01); *B65D 45/325* (2013.01); *B65D 53/02* (2013.01);
(Continued)

(58) Field of Classification Search
CPC ..... B60K 15/00–03177; B60K 2015/03493; B60K 2015/03256; B60K 2015/03542; F16K 24/00–04
See application file for complete search history.

(56) References Cited

U.S. PATENT DOCUMENTS 640,860 A * 1/1900 Baum ..... B65D 1/06 215/377
2,086,404 A * 7/1937 Daniels ..... A47G 19/2255 215/332
(Continued)

FOREIGN PATENT DOCUMENTS

CN 2083565 U 8/1991
CN 2631983 Y 8/2004
(Continued)

*Primary Examiner* — Kareen K Thomas

(57) ABSTRACT

Disclosed is a sealing cover, which is suitable for sealing an opening of a container, comprising an extrusion lid and a flexible sealing ring, wherein the container has an opening, the extrusion lid comprises an outer cover, an inner shield cover, a screw rod and a knob, the outer cover covers the opening, and the inner shield cover is arranged in the opening and is located under the outer cover; the screw rod movably penetrates the outer cover, the lower end of the screw rod is fixedly connected to the inner shield cover, and the upper end of the screw rod is connected in a threaded manner to the knob; and the flexible sealing ring is sheathed on the screw rod and is located between the outer cover and the inner shield cover, and when the knob is rotated, the screw rod drives the inner shield cover to move upwards and squeezes the flexible sealing ring to force the flexible sealing ring to be attached to an inner circumferential wall of the opening after expansion to form a seal. The sealing cover provided by the present invention can seal the opening of a container, and the sealing cover has a simple structure, is convenient to use, and has a good sealing effect.

9 Claims, 3 Drawing Sheets

(51) Int. Cl.
*B65D 45/32* (2006.01)
*B65D 53/02* (2006.01)

(52) U.S. Cl.
CPC ..... *B65D 2543/00574* (2013.01); *B65D 2543/00972* (2013.01)

(56) References Cited

U.S. PATENT DOCUMENTS

| | | | | |
|---|---|---|---|---|
| 8,511,493 | B2 * | 8/2013 | Bernstein | A47G 19/2205 215/200 |
| 10,035,644 | B2 * | 7/2018 | Perrulli | B65D 1/0276 |
| 2005/0092760 | A1 * | 5/2005 | Westerhold | A47G 19/2255 220/703 |
| 2010/0294770 | A1 * | 11/2010 | Wing | A47G 19/2205 220/270 |
| 2012/0233968 | A1 * | 9/2012 | Bernstein | A47G 19/2205 53/452 |
| 2018/0229904 | A1 * | 8/2018 | Zanatta | A47G 19/2255 |

FOREIGN PATENT DOCUMENTS

| | | | |
|---|---|---|---|
| CN | 204822503 | U | 12/2015 |
| GB | 677026 | A | 8/1952 |
| GB | 1032581 | A | 6/1966 |
| GB | 1492303 | A | 11/1977 |

* cited by examiner

SEALING COVER

FIELD OF THE INVENTION

The invention relates to a container, in particular to a sealing cover.

BACKGROUND OF THE INVENTION

The container is an instrument for containing solid or liquid objects. The wine cup is an instrument used for drinking, namely a container. Most of the basic devices are straight or open, and the wine glass is normally used, and is characterized in that wine in a wine bottle is poured into a wine cup, namely, and the wine is stored in a wine bottle; however, in daily life of people, on one hand, the full-full cup can not be completely drunk, in this case, the wine in the wine cup does not need to be poured back into the wine bottle for sanitary consideration, and can only be poured out, so that the waste of the wine water is caused; On the other hand, it may be related to go out, short-distance travel and the like, while in these cases, people often want to carry some wine water capable of meeting the own personal drinking component, for example, dozens of milliliters to several hundred milliliters or even more wine water, meanwhile, if one bottle of wine is carried, and the wine glass and the like are added, the carrying weight is increased, and the carrying is very inconvenient. In other words, for a container similar to a wine cup, the container cannot be sealed and is inconvenient to use.

SUMMARY OF THE INVENTION

The invention aims to overcome the defects in the prior art and provides a sealing cover According to the technical scheme, the technical scheme adopted by the invention is as follows: the sealing cover, and is suitable for sealing the opening of the container; the sealing cover comprises:

The extrusion cover comprises an outer cover and an inner baffle cover, a screw rod and a knob; the outer cover covers the opening, the inner blocking cover is arranged in the opening and is located below the outer cover; the screw rod is movably arranged on the outer cover in a penetrating mode, and the lower end of the screw is fixedly connected with the inner baffle, the upper end of the screw is in threaded connection with the knob;

The flexible sealing ring is arranged on the screw a rod and is located between the outer cover and the inner baffle cover, when the rotary knob rotates, the screw rod drives the inner baffle cover to move upwards and extrude the flexible sealing ring, so that the flexible sealing ring is forced to be expanded and then attached to the inner peripheral wall of the opening to form a seal;

Preferably, the inner circumferential wall of the flexible sealing ring is in a concave arc shape;

Preferably, a circle of protrusions are arranged on the inner bottom surface of the outer cover, wherein the upper periphery of the flexible sealing ring is arranged outside the bulge in a sleeving manner;

Preferably, two opposite guide planes are formed on the outer circumference of the screw rod, and a non-circular hole matched with the screw rod is formed in the outer cover, the screw rod can be vertically and slidably arranged in the non-circular hole in a penetrating mode Preferably, a threaded hole is formed in the bottom surface of the knob, with the threaded hole; the upper end of the screw rod is in threaded fit with the threaded hole;

Preferably, the lower end of the screw rod and the inner baffle cover are integrally formed;

Preferably, the upper peripheral edge of the flexible sealing ring is provided with an opening part which is folded to the outside of the opening, the opening part at least comprises a top wall part covering the top wall of the opening;

Preferably, the bag opening part further comprises a peripheral part covering the outer peripheral wall of the opening, and the peripheral part is tightly attached to the outer peripheral wall of the opening through a hoop clamp to form a seal;

Preferably, the hoop comprises a sleeve arranged on the periphery a clamping ring and a locking bolt for adjusting the size of the clamping ring;

Preferably, the container is a glass cup;

The sealing cover provided by the invention has the beneficial effects that the sealing cover is provided with an extrusion cover and a flexible sealing ring, when the knob of the extrusion cover is rotated, the screw rod drives the inner baffle cover to upwards extrude the flexible sealing ring, and the flexible sealing ring is forced to expand to be fitted and sealed with the inner peripheral wall of the opening, can seal similar containers such as wine cups, and is simple in structure, convenient to use and good in sealing effect.

Figure 1:
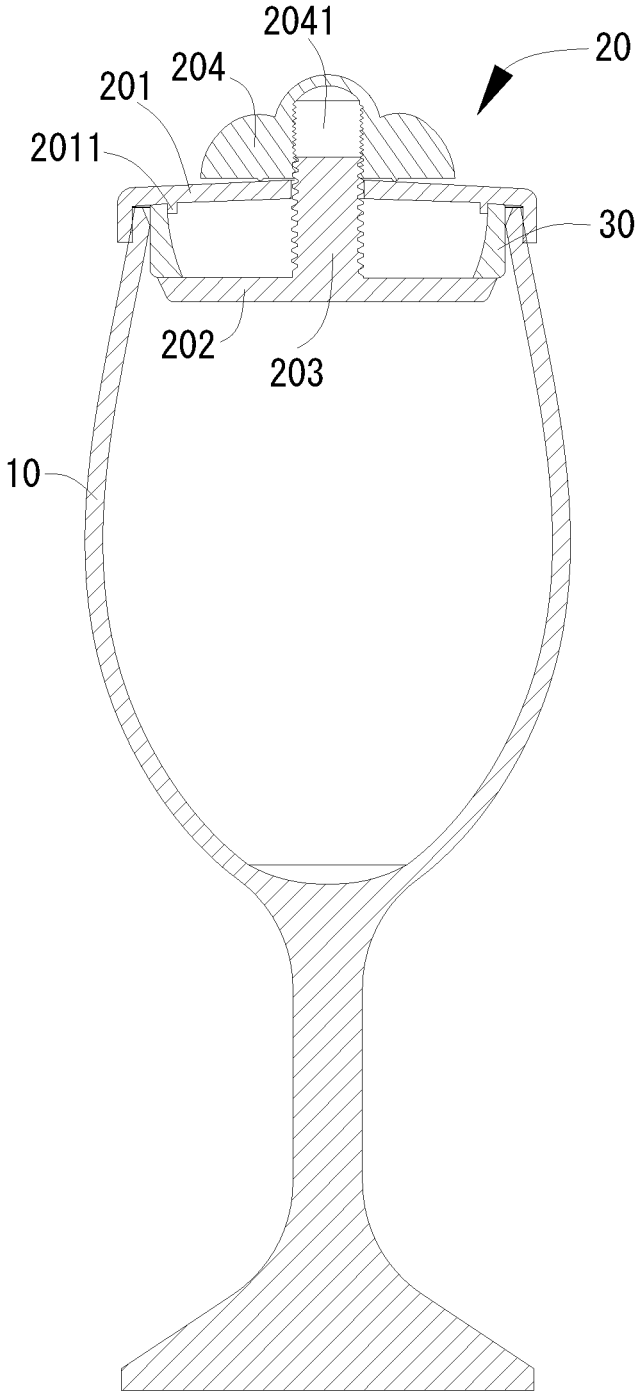
FIG. 1 is a schematic structural diagram of a sealing cover matched with a cup body according to an embodiment of the present invention.

Reference numeral: container 10; extrusion cover 20; outer cover 201; projection 2011; non-circular hole 2012; inner baffle cover 202, screw rod 203; guide plane 2031; inverted part 2032; knob 204; threaded hole 2041; flexible sealing ring 30; top wall part 301; peripheral part 302; hoop 40; collar 401; locking bolt 402

The method and the device have the advantages that the functions and the advantages are combined to be further described with reference to the accompanying drawings.

DETAILED DESCRIPTION OF THE PREFERRED EMBODIMENTS

Embodiments of the invention are described in detail below, examples of which are illustrated in the accompanying drawings, wherein the same or similar elements throughout the specification represent the same or similar elements or elements with the same or similar functions are exemplary by reference to the embodiments described with reference to the drawings, and is intended to be used for explaining the present invention and not to be construed as limiting the present invention.

In the description of the invention, it is to be understood that the terms "center" and "longitudinal" are used, "transverse", "length", "width", "thickness" and "upper", "lower", "front", "back", "left" and "right", "vertical", "horizontal", "top" and "bottom"", "inner" and "outer", the direction or the position relation indicated by the "counter-clockwise" and "clockwise" are based on the orientation or position relation shown in the figure, only in order to facilitate describing the present invention and to simplify the description, and not to indicate or imply that the indicated device or element must have a specific orientation, is constructed and operated in a specific orientation and therefore cannot be construed as a limitation of the present invention.

In addition, the terms "first" and "second" are used only for purposes of description, and cannot be understood to indicate or imply a relative importance or to implicitly indicate the number of the indicated technical features. Thus, a "first" is defined, the features of the "second" can be expressly or implicitly included in one or more of the features. In the description of the invention, the meanings of "multiple" are two or more, unless specifically limited otherwise.

In the invention, unless explicitly stated and defined otherwise, the terms "installed", "connected" and "connected", the terms "fixed" and the like should be construed broadly, for example, the fixed connection can be fixedly connected, and can also be detachably connected or integrally connected; can be mechanically connected or electrically connected, and can be directly connected or indirectly connected through an intermediate medium, the internal connection of the two elements can be realized by one of ordinary skill in the art, the specific meaning of the terms in the invention can be understood according to specific conditions.

Figure 3:
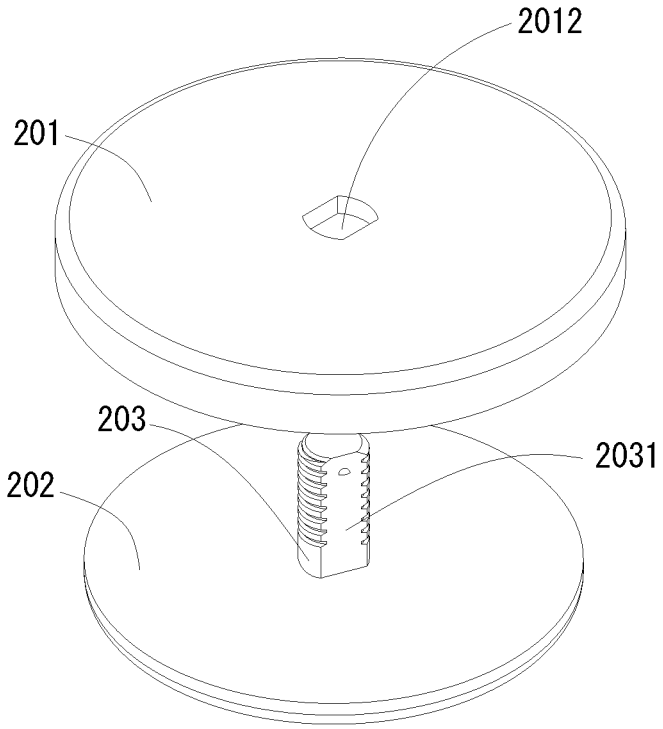
FIG. 3 is a schematic structural diagram of an outer cover, a screw and an inner blocking cover of an embodiment of the sealing cover of the embodiment of the invention.

Referring to FIG. 1 and FIG. 3, an embodiment of the present invention provides a sealing cover, and is suitable for sealing the container 10 (the container 10 in FIG. 1 and is a wine cup) is opened, that is, the container 10 is provided with an opening, the container 10 can be a glass cup, and the sealing cover is used for sealing the opening of the container 10;

The sealing cover comprises an extrusion cover 20 and a flexible sealing ring 30. The extrusion cover 20 comprises an outer cover 201, an inner baffle cover 202, a screw rod 203 and a knob 204, wherein the outer cover 201 covers the opening, the inner baffle cover 202 is arranged in the opening and is positioned below the outer cover 201, the outer cover 201 and the inner baffle cover 202 are oppositely arranged, and a certain gap is formed between the outer cover 201 and the inner baffle cover 202;

The screw rod 203 is movably arranged on the outer cover 201 in a penetrating mode, the lower end of the screw rod 203 is fixedly connected with the inner baffle cover 202, and the upper end of the screw rod 203 is in threaded connection with the knob 204. That is, the knob 204 is used for driving the screw 203 to move up and down, and when the knob 204 rotates, due to the fact that the screw rod 203 and the knob 204 are in threaded fit, the screw rod 203 can move up and down in the vertical direction on the outer cover 201. Correspondingly, due to the fact that the inner baffle cover 202 is fixedly connected to the lower end of the screw rod 203, when the screw rod 203 moves up and down, the inner baffle cover 202 can be driven to move up and down, so that the gap between the outer cover 201 and the inner baffle cover 202 can be reduced or increased;

The flexible sealing ring 30 is arranged on the screw rod 203 in a sleeved mode and is located between the outer cover 201 and the inner blocking cover 202, when the knob 204 rotates, the screw rod 203 drives the inner baffle cover 202 to move upwards and extrude the flexible sealing ring 30, and the flexible sealing ring 30 is forced to expand to be attached to the inner peripheral wall of the opening to form a seal. The flexible sealing can be made of flexible materials such as silica gel. That is, the flexible sealing ring 30 is arranged in a gap between the outer cover 201 and the inner blocking cover 202, when the rotary knob 204 rotates to drive the screw rod 203 to rise, the gap between the outer cover 201 and the inner baffle cover 202 is reduced, and then the flexible sealing ring 30 between the outer cover 201 and the inner baffle cover 202 is extruded, and the extruded flexible sealing ring 30 can expand to the periphery is further attached to the inner peripheral wall of the opening, so that a seal can be formed, and the liquid in the container 10 can be sealed and stored in the container 10 in a sealed mode, the flexible sealing ring 30 expands outwards to abut against the inner peripheral wall of the opening and also plays the role of fixing the whole extruding cover 20;

When the rotary knob is required to be opened, the rotary knob 204 is rotated reversely, so that the inner baffle cover 202 in the opening moves downwards, and then the extruded flexible sealing ring 30 is loosened, the elasticity of the flexible seal ring 30 is recovered to the original size, so that the extrusion cover 20 and the flexible seal ring 30 can be taken out integrally conveniently.

It should be noted that the outer cover 201 and the inner cover 202 are made of a hard material, the diameter of the outer cover 201 is slightly larger than the diameter of the opening, so that the cover can be conveniently covered on the opening, and the diameter of the inner baffle cover 202 is slightly smaller than the diameter of the opening so as to be put into and taken out.

The sealing cover provided by the invention comprises an extrusion cover 20 and a flexible sealing ring 30, when the rotary knob 204 of the extrusion cover 20 is rotated, the screw rod 203 drives the inner baffle cover 202 to extrude the flexible seal ring 30 upwards, and the flexible sealing ring 30 is forced to expand to be fitted and sealed with the inner peripheral wall of the opening, so that the opening of the wine glass and other containers can be sealed. The wine glass is taken as an example, and after sealing, the remaining wine water can be sealed and stored in the container 10 through the extrusion cover 20 and the flexible sealing ring 30, so that waste is avoided; meanwhile, a proper amount of wine water can be contained, the sealing is convenient, the use is convenient, and the sealing effect is good.

In one embodiment of the invention, the inner peripheral wall of the flexible sealing ring 30 is in a concave arc shape. As shown in FIG. 1, the inner peripheral wall of the flexible sealing ring 30 is recessed outward, in this way, when the inner baffle cover 202 moves upwards, the flexible sealing ring 30 is extruded, the expansion deformation of the flexible sealing ring 30 is facilitated, and the expansion effect of the flexible sealing ring 30 is improved.

Further, in one embodiment of the invention, a circle of protrusions 2011 is arranged on the inner bottom surface of the outer cover 201, the upper edge of the flexible sealing ring 30 is sleeved outside the protrusion 2011. That is, the upper periphery of the flexible sealing ring 30 is located on the periphery of the protrusion 2011, the protrusion 2011 can provide a positioning support for the upper peripheral edge of the flexible sealing ring 30, it is guaranteed that when the inner baffle cover 202 moves upwards, the flexible sealing ring 30 is extruded, the upper periphery of the flexible sealing ring 30 is kept in a circular state without deforming, so that the middle part of the flexible sealing ring 30 can expand outwards in the radial direction, so that the middle part of the expanded flexible sealing ring 30 can be completely attached to the inner peripheral wall of the opening without generating a local gap and the like. In other words, the sealing effect of the flexible sealing ring 30 after expansion can be further improved.

More advantageously, in one embodiment of the present invention, two opposite guide planes 2031 are formed on the outer circumference of the screw rod 203, and a non-circular hole 2012 matched with the screw rod 203 is formed in the outer cover 201, the screw rod 203 can be vertically and slidably arranged in the non-circular hole 2012 in a penetrating mode, when the knob 204 is rotated, the screw 203 can move up and down in the non-circular hole 2012 along the two guide planes 2031, that is, the two guide planes 2031 can play a role in guiding, so that the screw rod 203 can slide up and down, and the reliability of use is improved.

In addition, an inverted portion 2032 can also be arranged on the two guide planes 2031, when the screw rod 203 penetrates through the non-circular hole 2012 in the outer cover 201, the buckling part 2032 can prevent the screw rod 203 from falling off from the non-circular hole 2012, the inner blocking cover 202 and the flexible sealing ring 30 fall into the container 10;

More specifically, a threaded hole 2041 is formed in the bottom surface of the knob 204, and the upper end of the screw rod 203 is in threaded fit with the threaded hole 2041. In this way, when the knob 204 is rotated, the upper end of the screw 203 is in threaded fit with the threaded hole 2041, so that the screw rod 203 can move upwards, and the upper end of the corresponding screw rod 203 can move upwards in the threaded hole 2041. According to the matching mode, the screw rod 203 can move up and down, the structure is simple, and the operation is convenient.

Preferably, the lower end of the screw rod 203 is integrally formed with the inner baffle cover 202, so that the structure can be simplified and the cost can be reduced.

Figure 2:
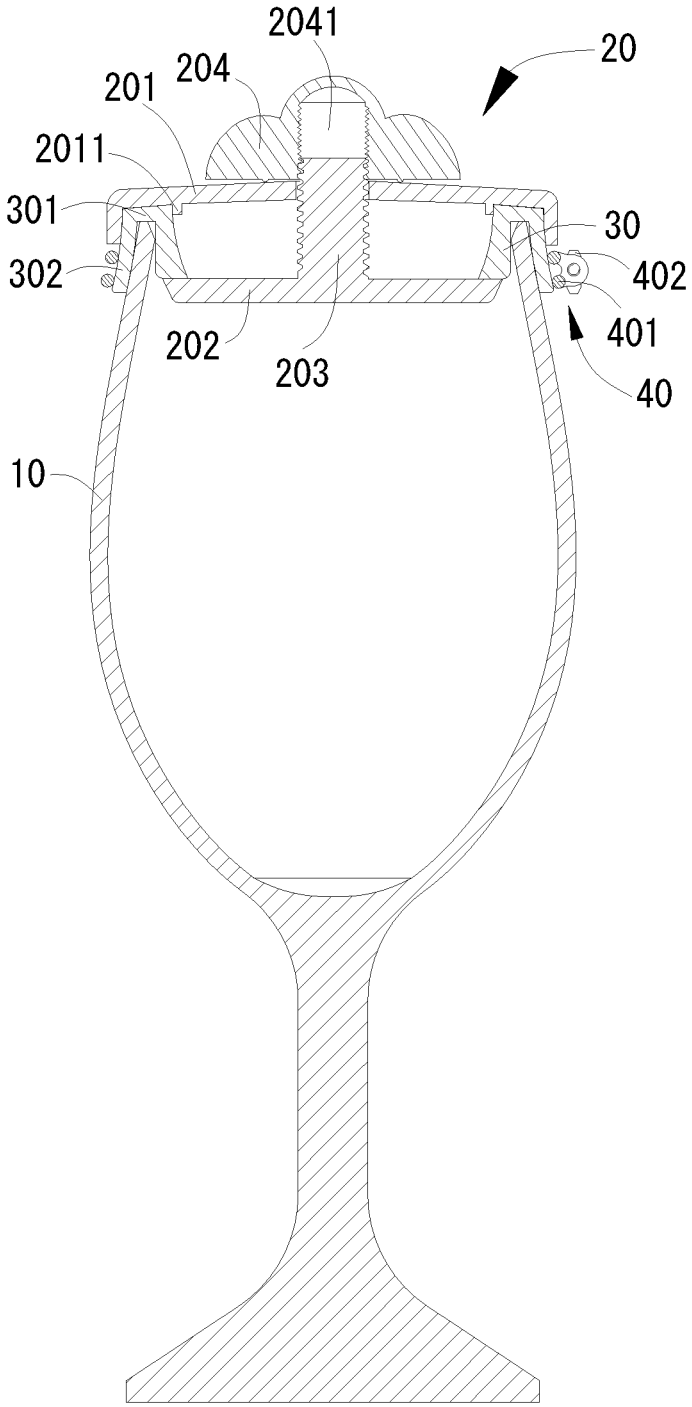
FIG. 2 is a schematic structural diagram of a sealing cover matched with a cup body according to another embodiment of the invention.

As shown in FIG. 2, in some embodiments of the present invention, the upper periphery of the flexible sealing ring 30 is provided with an opening part which is folded to the outside of the opening, wherein the opening part at least comprises a top wall part 301 covering the top wall of the opening, when the rotary knob 204 enables the screw rod 203 to drive the inner baffle cover 202 to extrude the flexible sealing ring 30 to expand and seal, the knob 204 also generates downward acting force for the outer cover 201, so that the inner bottom surface of the outer cover 201 presses the top wall part 301 on the top wall of the opening, so that the opening can be formed in the second way for sealing, so that the sealing effect is improved.

More advantageously, in one embodiment of the present invention, the opening part further comprises a peripheral part 302 covering the outer peripheral wall of the opening, the peripheral part 302 is tightly attached to the outer peripheral wall of the opening through a hoop 40 to form a seal.

In this way, a third seal can be formed between the peripheral portion 302 and the opening through the hoop 40, so that the sealing effect can be further improved.

In one embodiment of the invention, the clamping hoop 40 comprises a clamping ring 401 sleeving the periphery part 302 and a locking bolt 402 with the size of the adjusting clamping ring 401 in the using process, the clamping ring 401 is adjusted to be large, and the clamping ring 401 is sleeved on the peripheral portion 302, and then the clamping ring 401 is gradually tightened by adjusting the locking bolt 402, and then the peripheral part 302 hoop is tightly attached to the outer peripheral wall of the opening to form a seal, and is convenient to use; the strength of the clamping hoop 40 of the clamping ring 401 can be adjusted through the locking bolt 402, so that the sealing performance is better.

In conclusion, the sealing cover provided by the invention comprises an extrusion cover 20 and a flexible sealing ring 30, when the rotary knob 204 of the extrusion cover 20 is rotated, the screw rod 203 drives the inner baffle cover 202 to extrude the flexible seal ring 30 upwards, and the flexible sealing ring 30 is forced to expand to be fitted and sealed with the inner peripheral wall of the opening, so that the opening of the container 10 such as the wine cup can be sealed. The wine glass is taken as an example, and after sealing, the remaining wine water can be sealed and stored in the container 10 through the extrusion cover 20 and the flexible sealing ring 30, so that waste is avoided; meanwhile, a proper amount of wine water can be contained, the sealing is convenient, the use is convenient, and the sealing effect is good.

In the description of the specification, reference is made to the term "one embodiment", "some embodiments" and "examples", "specific examples", or "some examples" and the like are intended to refer to the same the specific features and structures described by the embodiment or the example, material or characteristic is included in at least one embodiment or example of the present invention, and the schematic expression of the terms does not necessarily refer to the same embodiment or example. Moreover, the specific features and structures are described, materials or features may be combined in any suitable manner in any one or more embodiments or examples.

Although embodiments of the present invention have been shown and described above, it is to be understood that, the embodiments are exemplary and cannot be construed as limiting the present invention, persons of ordinary skill in the art can change the above embodiments within the scope of the present invention without departing from the principles and principles of the present invention, modification, replacement and variation.

What is claimed is:

1. A sealing cover is suitable for sealing an opening of a container, the sealing cover is characterized in that the sealing cover comprises an extrusion cover, the extrusion cover comprises an outer cover, an inner baffle cover, a screw rod and a knob, the outer cover covers the opening, an inner blocking cover is arranged in the opening and is located below the outer cover; the screw rod is movably arranged on the outer cover in a penetrating mode, and a lower end of the screw is fixedly connected with the inner baffle, an upper end of a screw is in threaded connection with the knob; a flexible seal ring, the flexible sealing ring is arranged on the screw rod in a sleeved mode and is located between the outer cover and an inner blocking cover, when the rotary knob rotates, the screw rod drives the inner baffle cover to move upwards and extrude a flexible sealing ring, so that the flexible sealing ring is forced to be expanded and then attached to the inner peripheral wall of the opening to form a seal.

2. The sealing cover according to claim 1, wherein an inner circumferential wall of the flexible sealing ring is in a concave arc shape.

3. The sealing cover according to claim 1, and a circle of protrusions are arranged on an inner bottom surface of the outer cover, wherein an upper periphery of the flexible sealing ring is arranged outside a bulge in a sleeving manner.

4. The sealing cover according to claim 1, a threaded hole is formed in a bottom surface of the knob, with the threaded hole; an upper end of the screw rod is in threaded fit with the threaded hole.

5. The sealing cover according to claim 4, a lower end of the screw rod and the inner baffle cover are integrally formed.

6. The sealing cover according to claim 1, and an opening part which is folded to the outside of the opening is formed in an upper peripheral edge of the flexible sealing ring, the opening part at least comprises a top wall part covering the top wall of the opening.

7. The sealing cover according to claim 6, the opening part further comprises a peripheral part covering an outer peripheral wall of the opening, and the peripheral part is tightly attached to the outer peripheral wall of the opening through a hoop clamp to form a seal.

8. The sealing cover according to claim 7, a clamping ring and a locking bolt, wherein the clamping ring sleeves the periphery part; the locking bolt is used for adjusting a size of the clamping ring.

9. The sealing cover according to any one of the preceding claims, and is characterized in that the container is a glass cup.

* * * * *